US006897748B2

(12) United States Patent
Yamagata et al.

(10) Patent No.: US 6,897,748 B2
(45) Date of Patent: May 24, 2005

(54) CIRCUIT BREAKER

(75) Inventors: Hideto Yamagata, Saitama (JP); Koji Asakawa, Saitama (JP); Katsunori Kuboyama, Saitama (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 10/459,462

(22) Filed: Jun. 12, 2003

(65) Prior Publication Data

US 2003/0234710 A1 Dec. 25, 2003

(30) Foreign Application Priority Data

Jun. 19, 2002 (JP) ..... 2002-178513

(51) Int. Cl.[7] ..... H01H 67/02
(52) U.S. Cl. ..... 335/132; 335/202
(58) Field of Search ..... 335/132, 202, 335/6, 14, 20, 165–176; 200/293–308

(56) References Cited

U.S. PATENT DOCUMENTS 3,949,333 A * 4/1976 Freitag et al. ..... 335/132
4,345,225 A * 8/1982 Lemmer ..... 335/132
4,622,444 A * 11/1986 Kandatsu et al. ..... 200/303
4,774,484 A * 9/1988 Lehman et al. ..... 335/197
5,539,168 A * 7/1996 Linzenich ..... 200/303
6,111,489 A * 8/2000 Tiemann ..... 335/202
2002/0112946 A1 * 8/2002 Greenberg et al. ..... 200/50.32

FOREIGN PATENT DOCUMENTS

EP 0 511 042 10/1992
JP 7-169355 7/1995

* cited by examiner

*Primary Examiner*—Lincoln Donovan
(74) *Attorney, Agent, or Firm*—Manabu Kanesaka

(57) ABSTRACT

A circuit breaker has a main housing, and a pocket-shaped auxiliary equipment storage section is formed in the housing. A cassette type auxiliary switch is inserted into and attached to the auxiliary equipment storage section. The auxiliary switch is connected to a switching mechanism in the main housing of the circuit breaker so that the circuit breaker performs switching operations. The circuit breaker includes a locking device for positioning the auxiliary switch inserted into the auxiliary equipment storage section at a predetermined position. Further, an engagement-type stopper is provided for fixing the auxiliary switch at the position where the auxiliary switch is inserted into the auxiliary device storage section.

6 Claims, 5 Drawing Sheets

Fig. 7 Prior Art
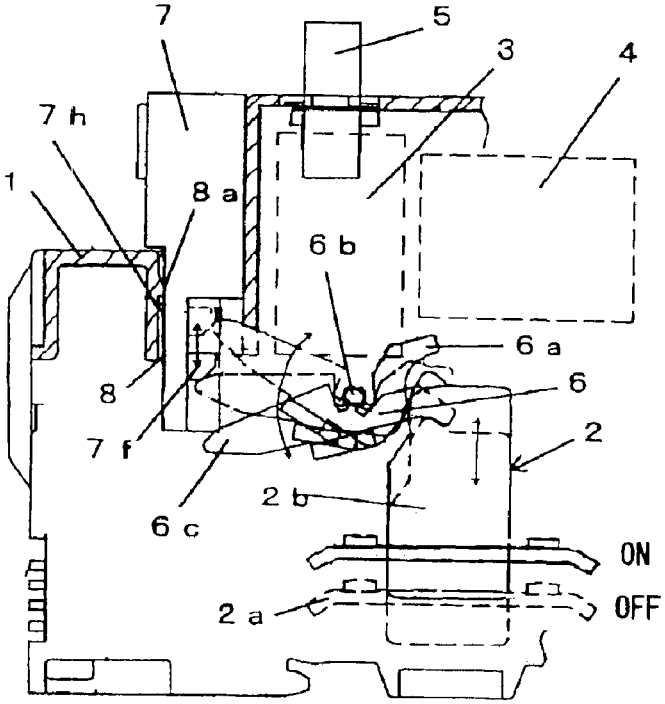
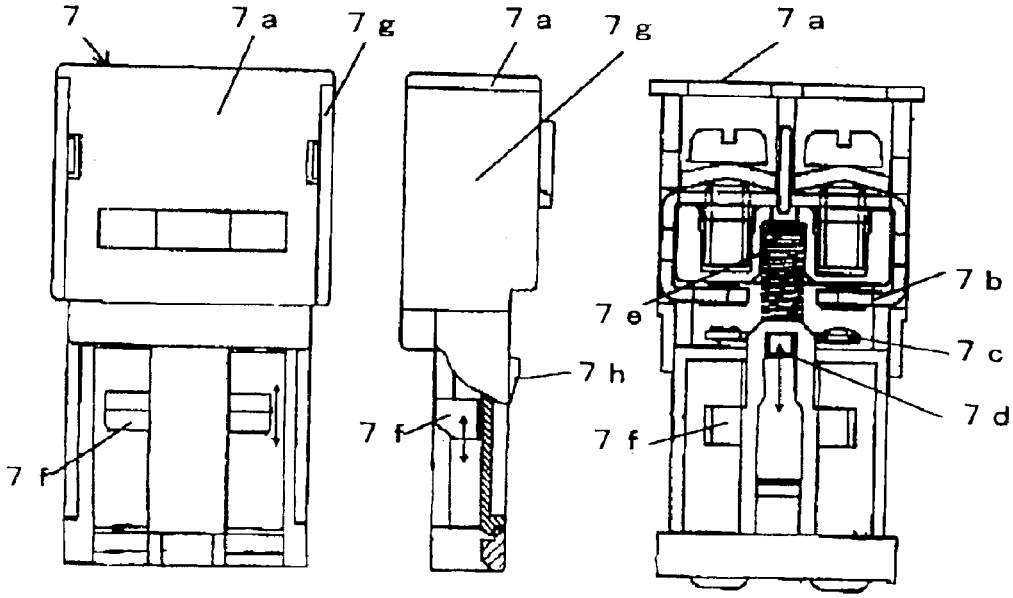
Fig. 8(a) Prior Art
Fig. 8(b) Prior Art
Fig. 8(c) Prior Art

CIRCUIT BREAKER

BACKGROUND OF THE INVENTION AND RELATED ART STATEMENT

The present invention relates to a circuit breaker such as an auto-breaker for protecting low-voltage distribution equipment from an over-current, and more specifically, a circuit breaker having an auxiliary switch for detecting ON/OFF states of a main circuit contact as an electric signal.

As an example of a circuit breaker, a structure of a conventional auto-breaker with an auxiliary switch attached to a main body housing is shown in FIGS. 7 and 8(*a*)–8(*c*). In FIG. 7, reference numeral 1 denotes a main body housing (molded resin housing) of the circuit breaker; reference numeral 2 denotes a current breaking section of a main circuit incorporated in the main body housing 1; reference numeral 3 denotes a switching mechanism section; reference numeral 4 denotes an over-current tripping device; reference numeral 5 denotes an operating handle for switching; reference numeral 6 denotes a switching lever of the switching mechanism section 3 for opening and closing a contact of the main circuit in the current breaking section 2; and reference numeral 7 denotes a cassette type auxiliary switch (an auxiliary switch that detects ON/OFF states of the main circuit contact as an electric signal) as an auxiliary (optional) equipment inserted into and detachably attached to a pocket-shaped auxiliary equipment storage section 8 formed on an upper surface of the main body housing 1.

The switching mechanism section 3 is comprised of a toggle link mechanism that moves in response to on/off operations of the operating handle 5 or an output of the overload current tripping device 4, and the switching lever 6 that opens or closes the main circuit contact in response to a movement of the toggle link mechanism. As shown in FIG. 7, the switching lever 6 is a seesaw-type lever that swings around a pivot 6*b*. An operational end 6*a* of the switching lever 6 faces a top of a contact holder 2*b* supporting a movable contact 2*a* of the current breaking section 2.

In response to the turning-off operation, a drive spring (not shown) is released to drive the switching lever 6 clockwise to push the movable contact holder 2*b* to open the main circuit contact. Conversely, in response to the turning-on operation, the switching lever 6 swings counterclockwise back to a position above the movable contact holder 2*b* while the drive spring is restored, thereby closing the main circuit contact. A leading end 6*c* of the switching lever 6 projects toward the auxiliary equipment storage section 8 to function as an actuator for turning on/off the auxiliary switch 7 attached to the auxiliary equipment storage section 8.

With the above arrangement, when the operating handle 5 is manually operated to the ON or OFF position, the main circuit contact in the current breaking section 2 is opened or closed through the switching lever 6 in the switching mechanism section 3. When an over-current flows through the main circuit, the over-current tripping device 4 sends an output signal to trip the switching mechanism 3 to open the main circuit contact as described above.

As shown in FIGS. 8(*a*)–8(*c*), the auxiliary switch 7 is comprised of a housing (molded resin) 7*a*. In the housing 7*a*, there are disposed fixed contacts 7*b*, bridging movable contacts 7*c*, a movable contact holder (a slider capable of moving up and down) 7*d*, a return spring 7*e* for the movable contact 7*c*, and an operating lever 7*f* connected to the movable contact holder 7*d*. A molded resin cover 7*g* covers a front of the housing 7*a* so that the auxiliary switch 7 is configured as a cassette type limit switch.

When the cassette-type auxiliary switch 7 is inserted into and attached to a predetermined position of the auxiliary equipment storage section 8 in the main body of the circuit breaker, the operating lever 7*f* overlaps the leading end 6*c* of the switching lever 6 in the main body of the circuit breaker, so that the auxiliary switch 7 is connected to the switching mechanism section 3 in the main body of the circuit breaker.

The auxiliary switch 7 operates as follows. In the ON state of the circuit breaker in which the main circuit contact is closed, the leading end 6*c* of the switching lever 6 is located at a lowered position. As a result, the return spring 7*e* pushes down the movable contact holder 7*d* of the auxiliary switch 7, so that the movable contacts 7*c* are released from the fixed contacts 7*b* (turning off the switch contact). According to the switch signal, it is detected that the main circuit contact is turned on.

On the other hand, in the OFF state of the circuit breaker in which the main circuit contact is opened by the operation of the handle or the tripping operation of the tripping device, the leading end 6*c* of the switching lever 6 swings clockwise to push up the operating lever 7*f* of the auxiliary switch 7 against the return spring 7*e*. As a result, the movable contact 7*c* and the fixed contact 7*b* are closed, and the auxiliary switch 7 sends the switch signal of turning off.

In the conventional structure shown in FIGS. 8(*a*)–8(*c*), a wedge locking claw 7*h* projecting from a lower part of the front surface of the cover 7*g* of the switch housing 7*a* is provided, so that the auxiliary switch 7 inserted in the auxiliary equipment storage section 8 in the main body of the circuit breaker is locked at a predetermined position. When the auxiliary switch 7 is pushed into the auxiliary equipment storage section 8 of the main body housing 1 as shown in FIG. 7, the claw 7*h* is hooked by snap-fitting on an engagement projection 8*a* formed on an inner wall surface of the auxiliary equipment storage section 8 to lock the auxiliary switch 7 at the predetermined position.

The conventional structure shown in FIGS. 7 and 8(*a*)–8(*c*) has the following problems in terms of the structure for supporting the auxiliary switch 7.

When the auxiliary switch 7 is inserted and pushed into the auxiliary equipment storage section 8 of the main body housing 1, the engagement claw 7*h* provided on the housing cover 7*g* of the auxiliary switch 7 hooks on the engagement projection 8*a* of the auxiliary equipment storage section 8. In this process, the housing cover 7*g* itself needs to be flexible so that the engagement claw 7*h* can move over the engagement projection 8*a*. However, if the cover 7*g* is flexible, when an external force is applied to the cover 7*g*, the cover deforms to change a posture of the auxiliary switch 7. Accordingly, the auxiliary switch 7 connected to the switching lever 6 in the main body of the circuit breaker becomes unstable to operate.

Further, with the configuration described above, it is difficult to release the engagement claw 7*h* from the engagement projection 8*a* when the auxiliary switch 7 is pulled out of the main body of the circuit breaker. In addition, when the auxiliary switch 7 is attached to and detached from the main body repeatedly, the locking part is deformed and worn down, thereby making it difficult to position the auxiliary switch 7 steadily and deteriorating the reliability.

In addition to the locking method using the snap-fitting as described above, Japanese Patent Publication (Tokkai) No. 07-169355 has disclosed a latch mechanism incorporated into an auxiliary switch. The latch mechanism is hooked on an auxiliary equipment storage section in the main body of a circuit breaker to lock the auxiliary switch at a predetermined position. However, with this mechanism, a structure of the auxiliary switch tends to be complicated and increase an outside dimension of the auxiliary switch, thereby deteriorating the space efficiency.

It is therefore an object of the present invention to provide a circuit breaker having an improved mounting structure of an auxiliary switch with a simple arrangement so that the auxiliary switch can be steadily locked at a predetermined position when the auxiliary switch is attached to the main body of the circuit breaker.

Further objects and advantages of the invention will be apparent from the following description of the invention.

SUMMARY OF THE INVENTION

To attain the above objects, according to the present invention, a circuit breaker has a main body housing, and a pocket-shaped auxiliary equipment storage section is formed in the housing. A cassette type auxiliary switch is inserted into and attached to the auxiliary equipment storage section at a predetermined position. The auxiliary switch is connected to a switching mechanism in the main body of the circuit breaker so that the circuit breaker performs switching operations. The circuit breaker includes a locking device for locking the auxiliary switch inserted into the auxiliary equipment storage section at the predetermined position. In the locking device, an engagement projection and an engagement groove are separately provided in a back surface of a cover of the auxiliary switch and in a wall surface of the main body housing opposite to the cover of the auxiliary switch for positioning the auxiliary switch. Further, an engagement-type stopper is provided for fixing the housing of the auxiliary switch at a position where the auxiliary switch is inserted into the auxiliary device storage section and the engagement projection engages the engagement groove.

In the present invention, the engagement-type stopper may include a cover capable of sliding up and down on a front surface of the housing of the auxiliary switch. In this case, in a state that the auxiliary switch is inserted into the auxiliary equipment storage section, the cover serving as the stopper is pushed from a retracted position to an opening edge of the auxiliary equipment storage section to hold the auxiliary switch at the predetermined position.

With this configuration, the housing and the cover of the auxiliary switch are constructed as rigid bodies, and are fitted to one another to lock the auxiliary switch at a predetermined position in the auxiliary equipment storage section of the main body of the circuit breaker. As a result, when the auxiliary switch is attached to and detached from the main body repeatedly, it is possible to constantly provide a stable and accurate positioning and improve the reliability. Further, since the cover of the auxiliary switch is capable of sliding to serve as the stopper, it is not necessary to provide additional part such as a latch mechanism, thereby making the auxiliary switch compact.

BRIEF DESCRIPTION OF THE DRAWINGS

FIG. 7 is a sectional view showing a structure of a conventional circuit breaker in a state that an auxiliary switch is attached; and FIGS. 8(*a*)–8(*c*) are views showing a detailed structure of the auxiliary switch in FIG. 7, wherein FIG. 8(*a*) is a backside view thereof, FIG. 8(*b*) is a side view thereof, and FIG. 8(*c*) is a front view showing an internal structure of the auxiliary switch with a cover removed.

DETAILED DESCRIPTION OF PREFERRED EMBODIMENTS

Figure 1A:
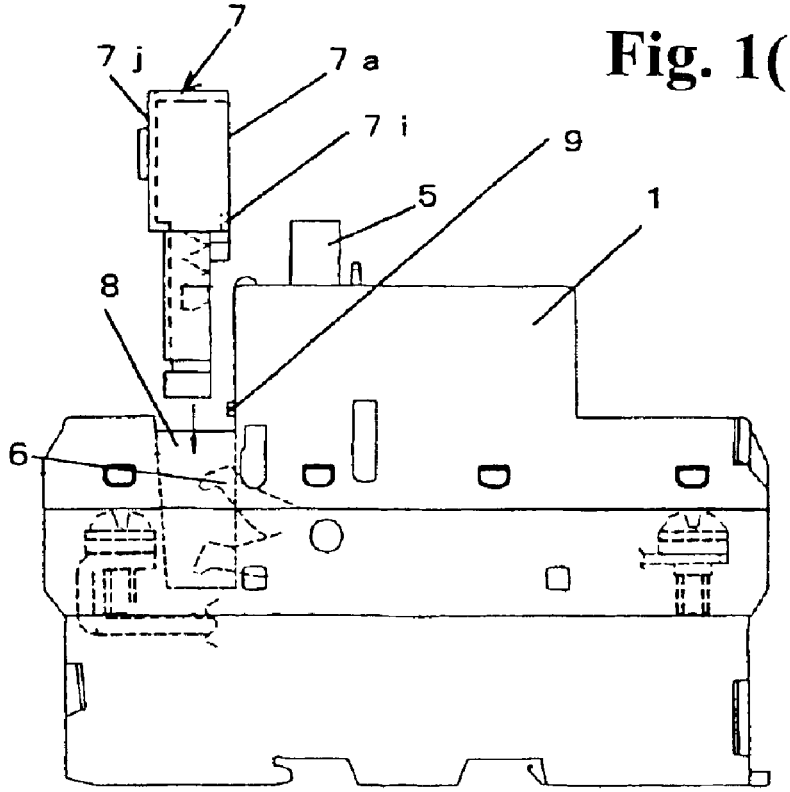
FIGS. 1(*a*) and 1(*b*) are views showing a structure of a circuit breaker according to the present invention, wherein FIG. 1(*a*) is a side view before an auxiliary switch is attached, and FIG. 1(*b*) is a side view after the auxiliary switch is attached.

Hereunder, preferred embodiments of the present invention will be explained in detail with reference to the accompanying drawings. Components corresponding to those in FIGS. 7 and 8(*a*)–8(*c*) are denoted by the same reference numerals, and the description thereof is omitted.

Figure 1B:
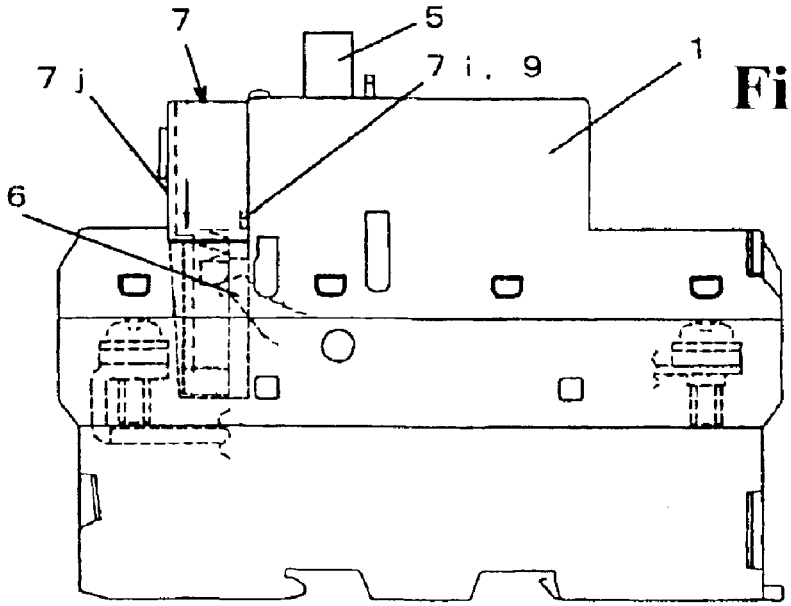
Figure 5:
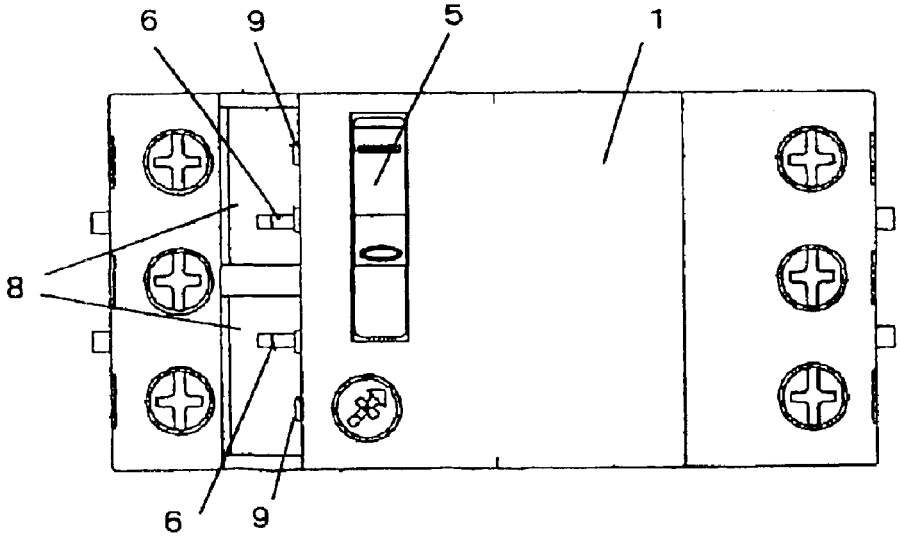
FIG. 5 is a plan view showing the circuit breaker in a state that the auxiliary switch is removed.
Figure 6:
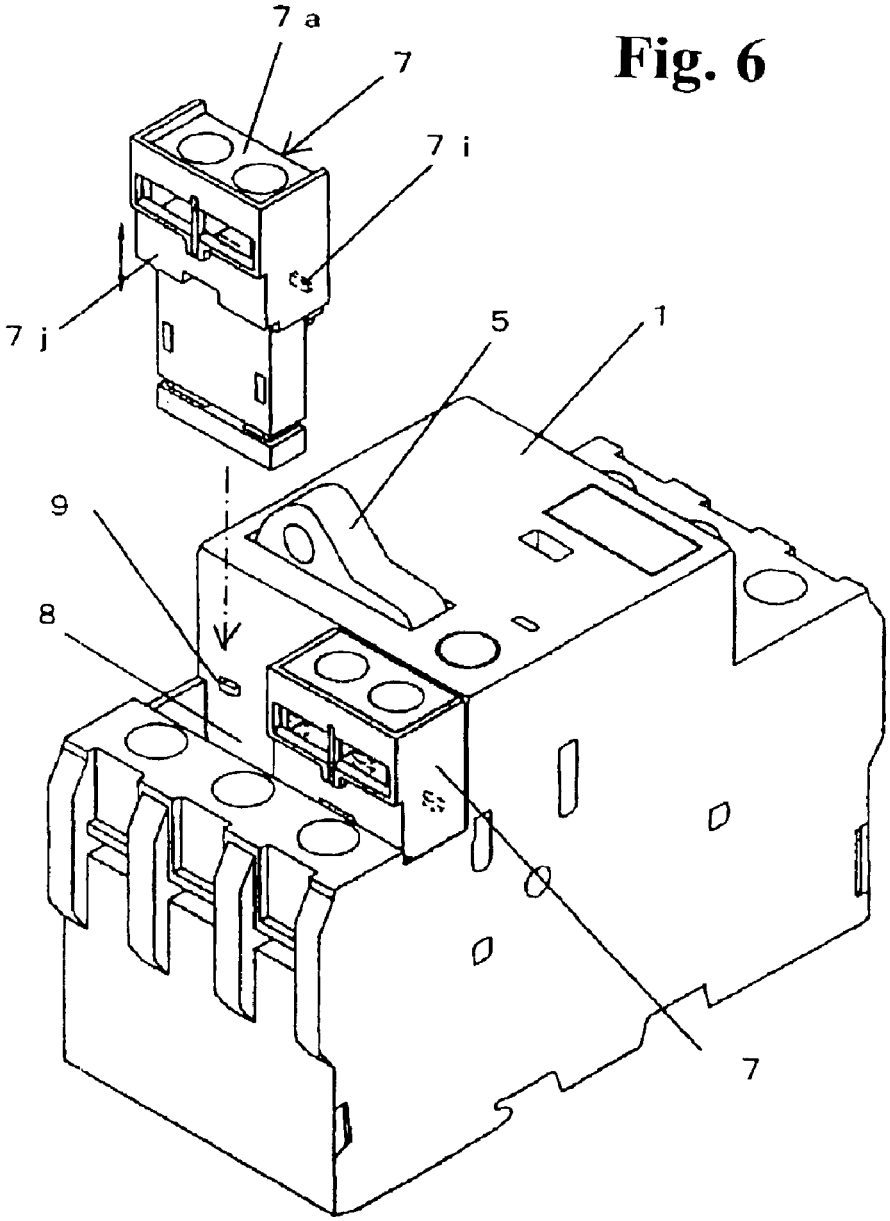
FIG. 6 is a perspective view showing the circuit breaker corresponding to FIGS. 1(*a*) and 1(*b*)

FIGS. 1(*a*), 1(*b*) and FIG. 6 illustrate a circuit breaker before and after an auxiliary switch is attached thereto, and FIG. 5 is a plan view showing the circuit breaker before the auxiliary switch is attached thereto. Specifically, pocket-shaped auxiliary equipment storage sections 8 are formed side by side in an upper surface of the main body housing 1 of the circuit breaker. Engagement projections 9 are formed on a wall surface of the main body housing 1 extending upward continuously from openings of the auxiliary equipment storage sections 8 for positioning auxiliary switches 7 inserted into the auxiliary equipment storage sections 8 at respective predetermined positions.

The auxiliary switch 7 has basically the same structure as the prior art shown in FIG. 8 except the following. As shown in FIG. 6, an engagement groove (concave groove) 7*i* is formed on a back surface of the housing 7*a* on which a contact mechanism is mounted for engaging the engagement projection 9 from a front when the auxiliary switch 7 is attached to the storage section 8. A cover 7*j* having a U-shaped section is attached to a front surface of the housing 7*a* as an engagement type stopper, and is guided and supported to slide vertically. It should be noted that the housing 7*a* and cover 7*j* of the auxiliary switch 7 are made of a rigid resin with little flexibility.

Further, outside dimensions of the auxiliary switch 7 are configured such that a width W (refer to FIG. 2) of an upper half part in which the contact mechanism is incorporated is nearly equal to a depth D of the auxiliary equipment storage section 8 formed in the main body housing 1 of the circuit breaker. Also, a width of the lower half part in which the movable contact operating lever 7*f* is incorporated is smaller than that of the upper half part. In accordance with the outside dimensions of the auxiliary switch 7, the sliding cover 7*j* has a step ΔW (refer to FIG. 2) in a width direction between the upper half part and the lower half part thereof.

Figure 2:
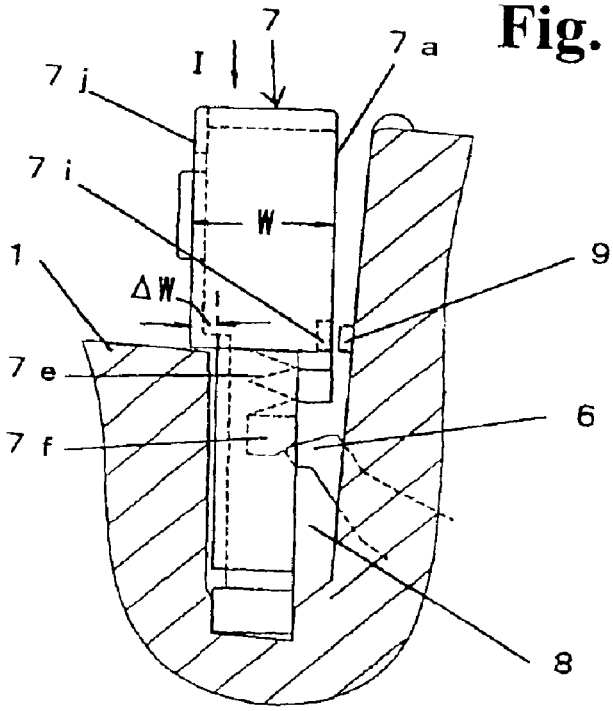
FIG. 2 is a view showing a process of attaching the auxiliary switch in FIGS. 1(*a*) and 1(*b*) to the circuit breaker in a state that a lower half part of the auxiliary switch is inserted into an auxiliary equipment storage section in a main body of the circuit breaker.
Figure 3:
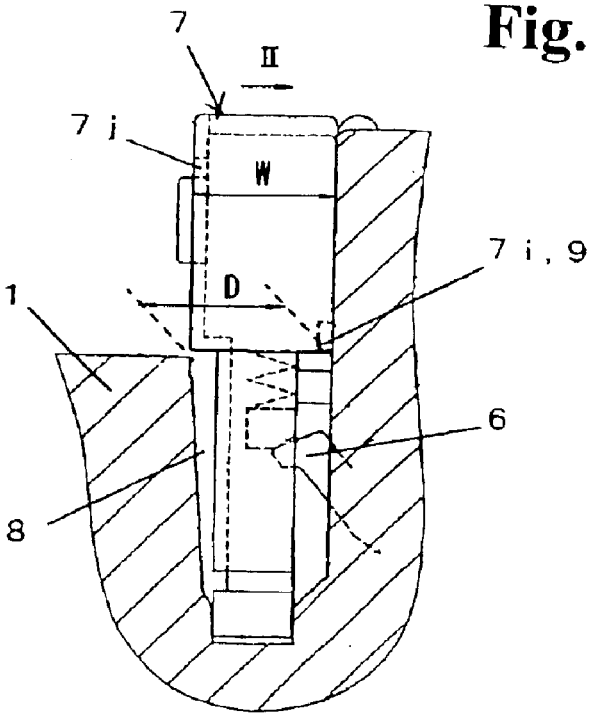
FIG. 3 is a view showing the process of attaching the auxiliary switch continued from FIG. 2 in a state that an engagement projection formed on a main body housing engages an engagement groove formed in the auxiliary switch to position the auxiliary switch.
Figure 4:
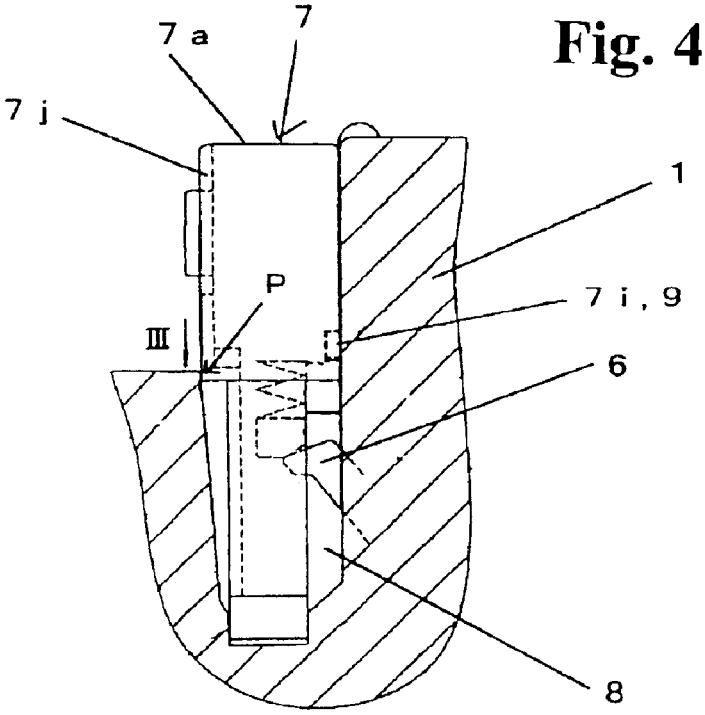
FIG. 4 is a view showing the process of attaching the auxiliary switch continued from FIG. 3 in a state that a sliding cover of the auxiliary switch is pulled down to engage the auxiliary equipment storage section.

With reference to FIGS. 2–4, a process of attaching the auxiliary switch 7 constructed as described above to the circuit breaker will be explained. First, in a state in which the sliding cover 7*j* of the auxiliary switch 7 is pulled upward, the lower half part of the auxiliary switch 7 in a slightly diagonal position is inserted into the pocket-shaped auxiliary equipment storage section 8 formed in the main body housing 1 from an arrow direction I.

Incidentally, in this case, since the sliding cover 7*j* is retracted upward, the lower half part of the auxiliary switch 7 can be inserted into such a depth that the engagement projection 9 faces the engagement groove 7*i* without an unnecessary interference between the upper half part of the cover 7*j* and the auxiliary equipment storage section 8. It should be noted that the operating lever 7*f* of the auxiliary switch 7 contacts the leading end of the switching lever 6, but has not been set at a proper attachment position yet.

Subsequently, as shown in FIG. 3, the auxiliary switch 7 is pressed from the front in an arrow direction II to engage the engagement groove 7*i* formed in the back surface of the housing 7*a* with the engagement projection 9 formed on the wall surface of the main body housing 1. In this state, the auxiliary switch 7 is positioned at a predetermined position based on the engagement projection 9. However, there is a play between the front surface of the auxiliary switch 7 and the inner wall of the auxiliary equipment storage section 8, so that the auxiliary switch 7 is not fixed in the width direction.

Then, while the auxiliary switch 7 is held at the position shown in FIG. 3, the sliding cover 7*j* is pulled down in an arrow direction III in FIG. 4. As a result, the step of the cover 7*j* (indicated by an arrow P) between the upper half part and the lower half part thereof is fitted into an edge of the opening of the auxiliary equipment storage section 8 to close the play mentioned above. Accordingly, it is possible to fix the auxiliary switch 7 at the proper attachment position not to move in the width, depth, and height directions.

Incidentally, when the auxiliary switch 7 is removed from the main body of the circuit breaker, the sliding cover 7*j* is pulled to the upper retracted position in an order revered from the order described above. The auxiliary switch 7 as a whole is tilted frontward to release the engagement projection 9 from the engagement groove 7*j*, so that the auxiliary switch 7 is easily pulled out of the auxiliary equipment storage section 8. Even if the auxiliary switch 7 is repeatedly attached and removed, the locking mechanism does not deform or wear down. Therefore, it is possible to always attach the auxiliary switch 7 to the main body of the circuit breaker at a predetermined position.

In the embodiment, the engagement projection 9 is formed on the main body housing 1 and the engagement groove 7*i* is formed in the back surface of the housing 7*a* of the auxiliary switch 7. However, the present invention is not limited to this configuration. Alternatively, an engagement projection may be formed on the back surface of the housing 7*a* of the auxiliary switch 7 and an engagement groove may be formed in the wall surface of the main body housing 1.

As described above, according to the present invention, the following effects can be obtained. In the conventional circuit breaker, the auxiliary switch is attached to the main body of the circuit breaker by snap fitting. In the present invention, it is not necessary to provide a positioning member deforming elastically for attaching the auxiliary switch to the main body of the circuit breaker. As a result, it is possible to position the auxiliary switch at a predetermined position with a high accuracy.

The auxiliary switch is inserted into the auxiliary equipment storage section and locked at a predetermined position therein by engaging rigid bodies with each other. Therefore, even if the auxiliary switch is repeatedly attached to and removed from the main body of the circuit breaker, a high positioning accuracy can be constantly ensured to improve the reliability.

Further, the cover of the auxiliary switch is capable of sliding and functioning as a stopper for locking the auxiliary switch at a predetermined position. Therefore, it is not necessary to provide an additional part such as a latch mechanism and make the auxiliary switch compact.

While the invention has been explained with the specific embodiments of the invention, the explanation is illustrative and the invention is limited only by the appended claims.

What is claimed is:

1. A circuit breaker comprising:

a main housing having an auxiliary equipment storage section, a switching mechanism disposed in the main housing, an auxiliary switch to be disposed in the auxiliary equipment storage section and connected to the switching mechanism, locking means situated between the main housing and the auxiliary switch for positioning the auxiliary switch in the auxiliary equipment storage section, said locking means preventing the auxiliary switch from moving in a predetermined direction when the auxiliary switch is located at a predetermined position in the auxiliary equipment storage section, and stopper means situated between the main housing and the auxiliary switch, said stopper means being operated to fix the auxiliary switch in the auxiliary equipment storage section after the auxiliary switch is disposed in the auxiliary equipment storage section and located at the predetermined position, said auxiliary equipment storage section having a size greater than that of the auxiliary switch so that the auxiliary switch located in the auxiliary equipment storage section can be moved to the predetermined position where the locking means is actuated.

2. A circuit breaker according to claim 1, wherein said locking means includes an engagement projection formed on one of the main housing and the auxiliary switch, and an engagement groove formed on the other of the main housing and the auxiliary switch for receiving the engagement projection.

3. A circuit breaker according to claim 2, wherein said engagement projection is formed on one of a back surface of the auxiliary switch and a wall surface of the main housing facing the back surface of the auxiliary switch, and said engagement groove is formed on the other of the back surface of the auxiliary switch and the wall surface of the main housing.

4. A circuit breaker according to claim 1, wherein said auxiliary switch is a cassette device so that the auxiliary switch is inserted in and removed from the circuit breaker.

5. A circuit breaker according to claim 1, wherein said auxiliary equipment storage section is formed in a pocket shape in the main housing.

6. A circuit breaker according to claim 1, wherein said stopper means includes a cover member attached to the auxiliary switch to slide up and down thereon, said cover member sliding from a retracted position to an opening edge of the auxiliary equipment storage section to fix the auxiliary switch at the predetermined position in a state where the auxiliary switch is inserted into the auxiliary equipment storage section.

* * * * *